US007338337B2

(12) United States Patent
Yamauchi et al.

(10) Patent No.: US 7,338,337 B2
(45) Date of Patent: Mar. 4, 2008

(54) AGING METHOD OF PLASMA DISPLAY PANEL

(75) Inventors: Masaaki Yamauchi, Osaka (JP); Takashi Aoki, Osaka (JP); Akihiro Matsuda, Osaka (JP); Koji Akiyama, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 115 days.

(21) Appl. No.: 10/510,984

(22) PCT Filed: Feb. 16, 2004

(86) PCT No.: PCT/JP2004/001651

§ 371 (c)(1),
(2), (4) Date: Oct. 13, 2004

(87) PCT Pub. No.: WO2004/075235

PCT Pub. Date: Sep. 2, 2004

(65) Prior Publication Data

US 2005/0215159 A1 Sep. 29, 2005

(30) Foreign Application Priority Data

Feb. 19, 2003 (JP) ..... 2003-041125

(51) Int. Cl.
*H01J 9/44* (2006.01)
*G09G 3/10* (2006.01)
*G09G 3/28* (2006.01)

(52) U.S. Cl. ..... 445/6; 315/169.1; 445/5; 345/60

(58) Field of Classification Search ..... 445/3, 445/5–6; 315/169.1, 169.3, 169.4, 62–63, 315/66–70; 345/60
See application file for complete search history.

(56) References Cited

U.S. PATENT DOCUMENTS

| | | | | |
|---|---|---|---|---|
| 6,376,995 | B1 * | 4/2002 | Kato et al. | 315/169.3 |
| 6,666,738 | B1 * | 12/2003 | Kado et al. | 445/6 |
| 6,924,795 | B2 * | 8/2005 | Kawasaki et al. | 345/204 |
| 2002/0008680 | A1 * | 1/2002 | Hashimoto et al. | 345/63 |
| 2003/0030377 | A1 * | 2/2003 | Hirano et al. | 313/587 |

FOREIGN PATENT DOCUMENTS

| | | |
|---|---|---|
| JP | 2000-231883 | 8/2000 |
| JP | 2001-357787 | 12/2001 |

(Continued)

*Primary Examiner*—Nimeshkumar D. Patel
*Assistant Examiner*—Anne M Hines
(74) *Attorney, Agent, or Firm*—Wenderoth, Lind & Ponack, L.L.P.

(57) ABSTRACT

In the aging process performed by applying a voltage having an alternating voltage component between a scan electrode and a sustain electrode, an erase discharge occurs in succession to an aging discharge. According to the aging method, an erase discharge-suppressing voltage is applied to at least any one of the scan electrode, the sustain electrode, and the data electrode. Although the erase discharge repeatedly occurs in the wake of the aging discharge, the erase discharge-suppressing voltage suppresses the ones that occur when the scan electrode has voltage level higher than the sustain electrode.

8 Claims, 10 Drawing Sheets

FOREIGN PATENT DOCUMENTS

| | | |
|---|---|---|
| JP | 2002-75208 | 3/2002 |
| JP | 2002-231141 | 8/2002 |
| JP | 2002-352722 | 12/2002 |
| JP | 2002-352730 | 12/2002 |
| JP | 2002-358891 | 12/2002 |
| JP | 2002-373588 | 12/2002 |
| JP | 3439462 B2 * | 8/2003 |
| JP | 2003-308781 | 10/2003 |
| JP | 2003-317625 | 11/2003 |

* cited by examiner

AGING METHOD OF PLASMA DISPLAY PANEL

TECHNICAL FIELD

The present invention relates to a method of aging an alternating current (AC) plasma display panel.

BACKGROUND ART

A plasma display panel (hereinafter referred to as a PDP or simply a panel) is a display device with excellent visibility, large screen, and low-profile, lightweight body. The difference in discharging divides PDPs into two types of the alternating current (AC) type and the direct current (DC) type. In terms of the structure of electrodes, the PDPs fall into the 3-electrode surface discharge type and the opposing discharge type. In recent years, the dominating PDP is the AC type 3-electrode surface discharge PDP by virtue of having higher resolution and easier fabrication.

Generally, the AC type 3-electrode surface discharge PDP contains a front substrate and a back substrate oppositely disposed from each other, and a plurality of discharge cells therebetween. On a front glass plate of the front substrate, scan electrodes and sustain electrodes as display electrodes are arranged in parallel with each other, and over which, a dielectric layer and a protecting layer are formed to cover the display electrodes. On the other hand, on a back glass plate of the back substrate, data electrodes are disposed in a parallel arrangement, and over which, a dielectric layer is formed to cover the electrodes. On the dielectric layer between the data electrodes, a plurality of barrier ribs is formed in parallel with the rows of the data electrodes. Furthermore, a phosphor layer is formed between the barrier ribs and on the surface of the dielectric layer. The front substrate and the rear substrate are sealed with each other so that the display electrodes are orthogonal to the data electrodes in the narrow space between the two substrates. The narrow space, i.e., the discharge space, is filled with discharge gas. The panel is thus fabricated.

Such a panel just finished, however, generally exhibits a high voltage at the start of discharging, and the discharge itself is in an unstable condition. The panel is therefore aged in the manufacturing process to obtain consistent and stable discharge characteristics.

Conventionally, a method—in which an anti-phased rectangular wave, that is, voltage having an alternate voltage component, is placed between the display electrodes, i.e., a scan electrode and a sustain electrode, for a long period of time—has been employed for aging panels. To shorten the aging time, some methods have been suggested. For example, Japanese Patent Non-Examined Publication No. H07-226162 introduces the method in which a rectangular wave is applied, via an inductor, to the electrodes of a panel. On the other hand, Japanese Patent Non-Examined Publication No. 2002-231141 suggests the method as a combination of two kinds of discharging. According to the method, pulse voltage having different polarity is placed between a scan electrode and a sustain electrode (i.e., discharging in the same surface) and consecutively, pulse voltage having different polarity is now placed between the display electrodes and the data electrodes (i.e., discharging between the opposite surfaces).

Even employing the methods above, the aging time still takes about 10 hours before obtaining a stabilized discharging. The long aging time inevitably increases power consumption in the aging process, which has been a leading cause of increasing the running cost of manufacturing PDPs. Besides, the time-consuming aging process has caused problems: the factory space for keeping the panels for the aging process, and environmental conditions, such as air-conditioning, for properly maintaining the panels through the manufacturing process. From now on, further increase in manufacturing volumes and screen-sizes of the PDP apparently encourages the problems above and invites serious conditions.

The present invention addresses the problems above. It is therefore an object of the invention to provide an improved method of aging panels, allowing the aging time to be significantly reduced with an efficient use of electric power.

SUMMARY OF THE INVENTION

According to the method of aging PDPs of the present invention, in the aging process where a voltage having an alternating voltage component is placed at least between a scan electrode and a sustain electrode to perform aging discharge, a voltage is applied to at least one of the scan electrode, sustain electrode, and data electrode so as to suppress an erase discharge that occurs in the wake of the aging discharge.

DETAILED DESCRIPTION OF THE INVENTION

The exemplary embodiments of the present invention are described hereinafter with reference to the accompanying drawings.

FIRST EXEMPLARY EMBODIMENT

Figure 1:
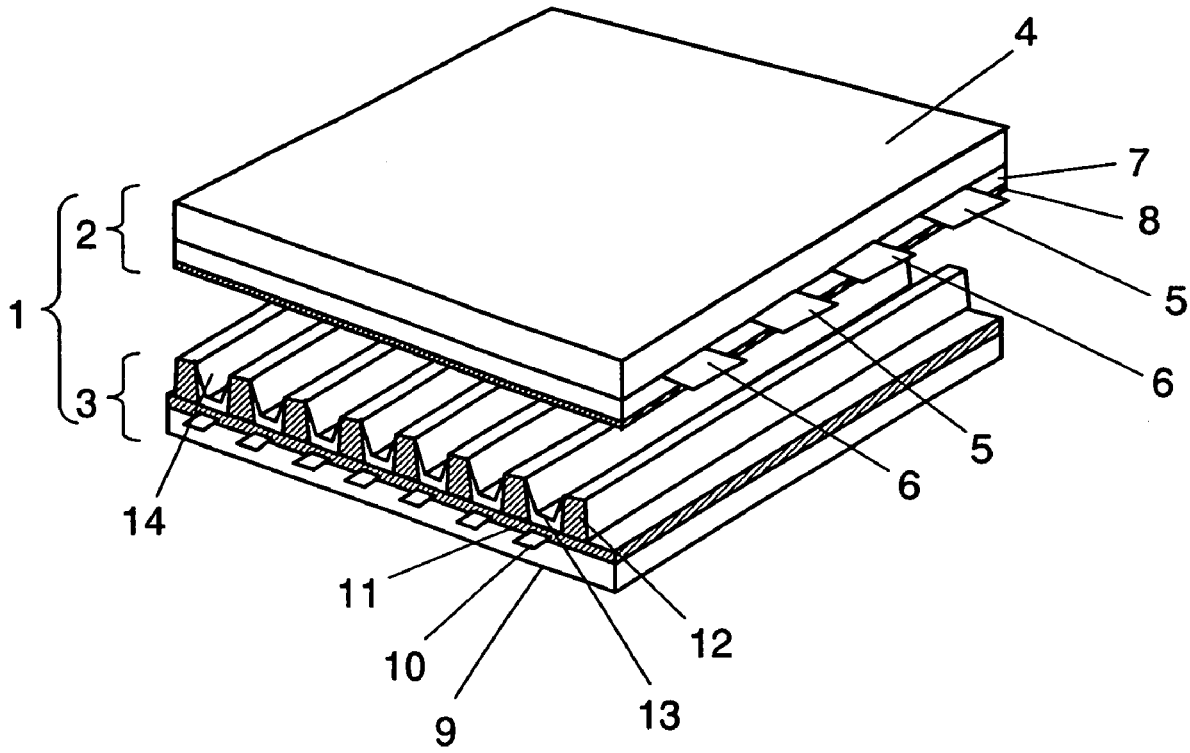
FIG. 1 is an exploded perspective view illustrating the structure of a panel on which aging of an exemplary embodiment of the present invention is to be performed.

FIG. 1 is an exploded perspective view illustrating the structure of a panel on which aging of an exemplary embodiment of the present invention is to be performed. Panel 1 contains front substrate 2 and back substrate 3 in a confronting arrangement. On front glass plate 4 of front substrate 2, a plurality of pairs of scan electrodes 5 and sustain electrodes 6 is arranged in parallel. The array of scan electrodes 5 and sustain electrodes 6 are covered with dielectric layer 7, and over which, protecting layer 8 is formed to cover dielectric layer 7. On the other hand, on back glass plate 9 of back substrate 3, a plurality of data electrodes 10 is disposed in a parallel arrangement, and over which, dielectric layer 11 is formed to cover electrodes 10. On dielectric layer 11, a plurality of barrier ribs 12 is formed in parallel with the rows of data electrodes 10. Furthermore, phosphor layer 13 is formed between barrier ribs 12 and on the surface of dielectric layer 11. Discharge spaces 14 between front substrate 2 and back substrate 3 are filled with discharge gas.

Figure 2:
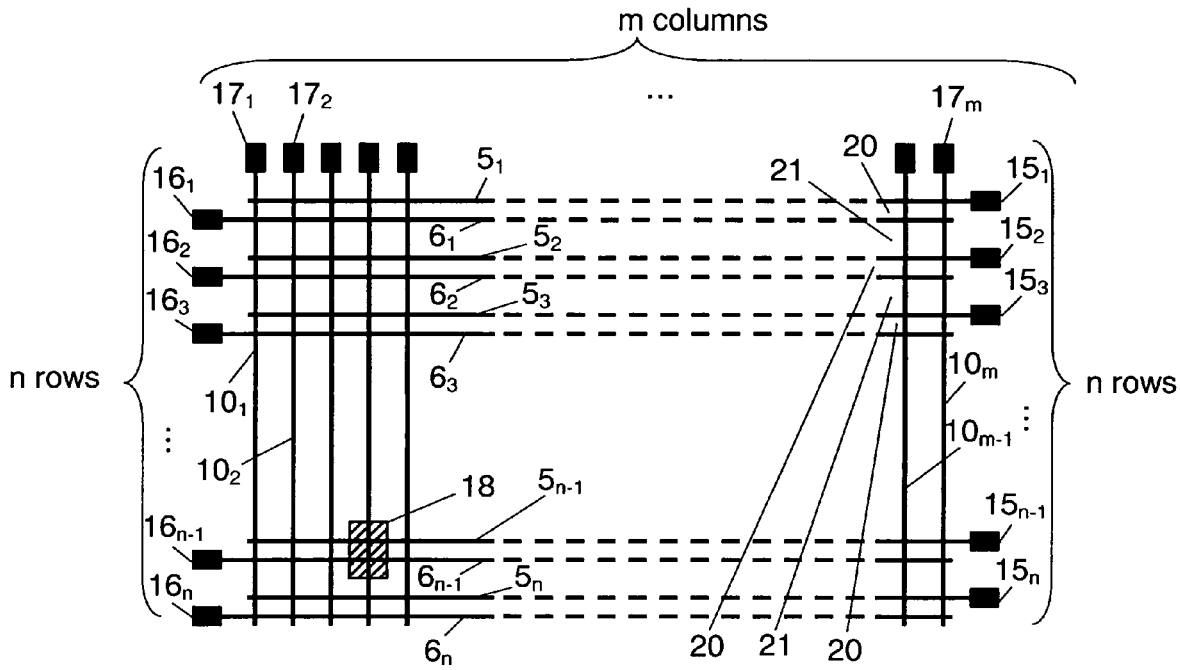
FIG. 2 shows the arrangement of electrodes of the panel.

FIG. 2 shows the arrangement of electrodes of panel 1 of the embodiment. m data electrodes $\mathbf{10}_1$-$\mathbf{10}_m$ (corresponding to data electrodes 10 shown in FIG. 1) are arranged in a direction of rows. On the other hand, in a direction of columns, n scan electrodes $\mathbf{5}_1$-$\mathbf{5}_n$ (scan electrodes 5 of FIG. 1) and n sustain electrodes $\mathbf{6}_1$-$\mathbf{6}_n$ (sustain electrodes 6 of FIG. 1) are alternately disposed. The array of the electrodes above forms m×n discharge cells 18 in the discharge space. Each of cells 18 contains a pair of scan electrode $\mathbf{5}_i$ and sustain electrode $\mathbf{6}_i$ (i takes 1 to n) and one data electrode $\mathbf{10}_i$ (j takes 1 to m). Scan electrode $\mathbf{5}_i$ is connected to corresponding electrode terminal section $\mathbf{15}_i$ disposed around the perimeter of the panel. Similarly, sustain electrode $\mathbf{6}_i$ is connected to sustain electrode terminal section $\mathbf{16}_i$; and data electrode $\mathbf{10}_j$ is connected to data electrode terminal section $\mathbf{17}_j$. Here, the gap formed between scan electrode 5 and sustain electrode 6 for each of cells 18 is referred to as discharge gap 20, and the gap formed between the discharge cells, i.e., between scan electrode $\mathbf{5}_i$ and sustain electrode $\mathbf{6}_{i-1}$ that belongs to the next discharge cell, is referred to as adjacent gap 21.

Figure 3A:
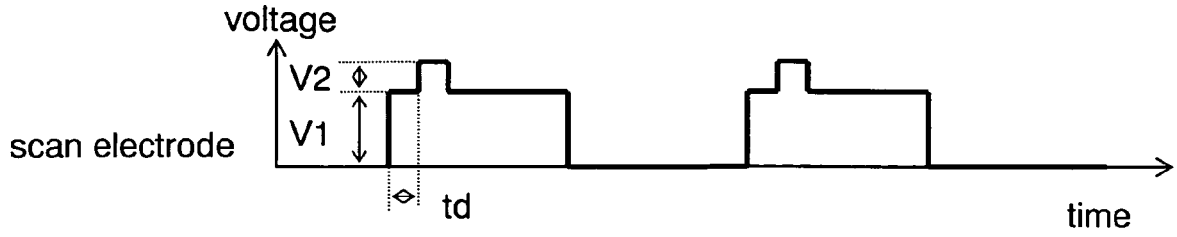
FIGS. 3A-3E show waveforms of voltage applied to an electrode in the aging method of a first exemplary embodiment.
Figure 3B:
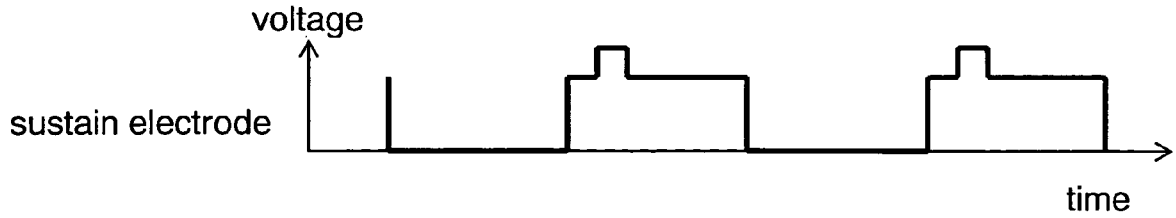
Figure 3C:
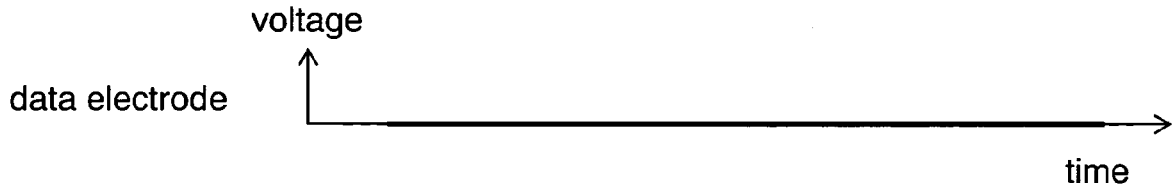

FIGS. 3A-3E show waveforms of voltage applied to an electrode in the aging method of the embodiment. Specifically, FIGS. 3A, 3B, and 3C show a voltage waveform for scan electrode 5, sustain electrode 6, and data electrode 10, respectively. According to the aging method of the embodiment, as is apparent from the figures, the waveforms of voltage applied to scan electrode 5 and sustain electrode 6 do not exhibit a simple series of rectangular form. They show another small rise with a delayed time of td after the rising edge of voltage. The result of the experiment—where, each value of FIGS. 3A-3E is set as follows: V1=200V, V2=100V, td=3 μs, (the pulse-repetition period is constantly defined to 25 μs)—showed that the aging time was cut in half that of a conventional method.

It will be understood that the optimal values of voltage V1, V2 and time distance td depend on the shape and dimensions of the electrodes, the material of a panel, and inductance of an aging circuit. Therefore, the setting values have to be changed for a differently designed panel.

Figure 4A:
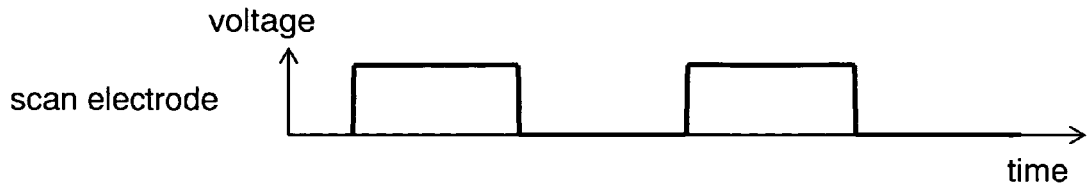
FIGS. 4A-4E show waveforms of voltage applied to an electrode in a conventional aging method, a voltage waveform at an electrode terminal section, and a light-emission waveform of a panel.
Figure 4B:
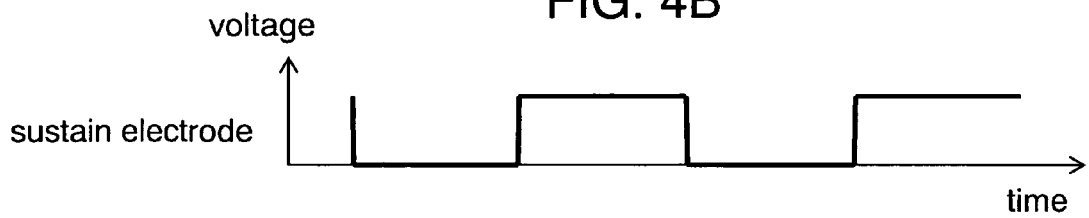
Figure 4C:
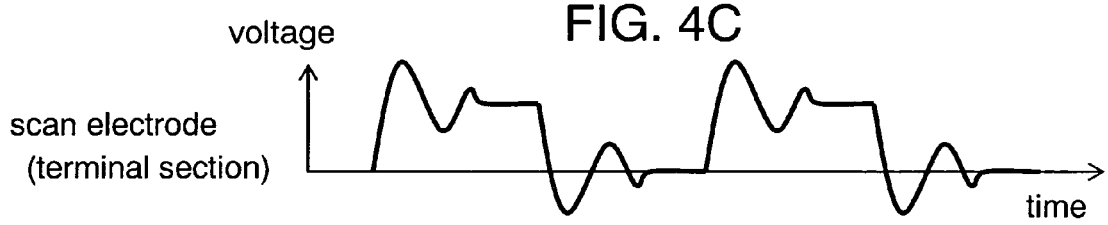
Figure 4D:
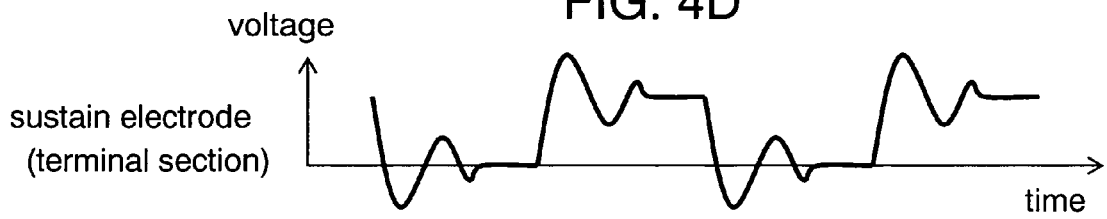

Now will be described the reason why the aging method of the embodiment can shorten the aging time. FIGS. 4A and 4B show waveforms of voltage applied to scan electrode 5 and sustain electrode 6, respectively, in a conventional aging method. At this time, scan electrode terminal section 15 and sustain electrode terminal section 16 exhibit respective voltage waveforms, which are schematically shown in FIGS. 4C and 4D. As shown in the figures, in spite of the fact that the voltage waveform generated is rectangular in shape, ringing is superimposed on the rectangular shape of each waveform at terminal sections 15 and 16. Although the phenomenon is unavoidable in an aging circuit incorporating an inductor, even in a circuit with no inductor, it also occurs from resonance of floating inductance and capacity of a panel. That is, the ringing is inevitably superimposed on the voltage waveform at the electrode terminal section.

Figure 4E:
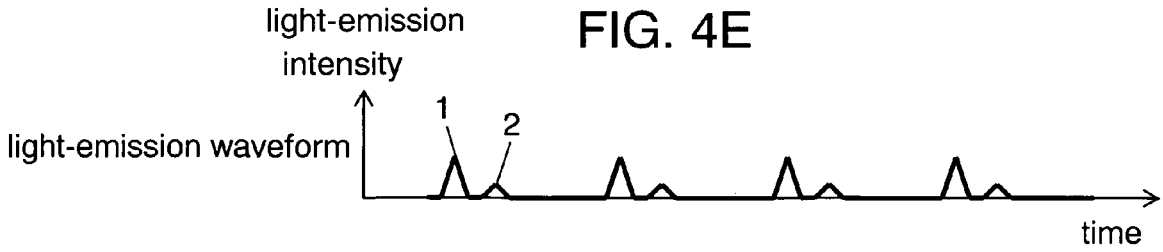

FIG. 4E schematically shows light emission of a panel as a light-emission waveform detected with a photo sensor. Each crest of the waveform shows the moment at which the discharge occurs. In FIG. 4E, minor discharge (2) following major discharge (1), which occurs in the wake of overshoot, is an erase discharge that erases wall charge. The erase discharge has little aging effect in spite of consuming electric power. Besides, due to the weakened wall discharge, a large voltage is required to generate the following discharge, resulting in reduced efficiency of aging. Furthermore, the magnitude of the erase discharge depends on the characteristics of each discharge cell; and the aging time takes longer for the cell that is likely to have erase discharge. To perform the aging process satisfactorily for all the discharge cells, further aging time is required.

According to the aging method of the first embodiment, in order to suppress the erase discharge that follows the aging discharge, a voltage is applied to scan electrodes 5 and sustain electrodes 6 at the exact moment when the erase discharge occurs. As a result, an efficient aging can be obtained. The detection of the light emission of the panel by a photo-sensor proved that light emission in the wake of the erase discharge weakened.

Figure 3D:
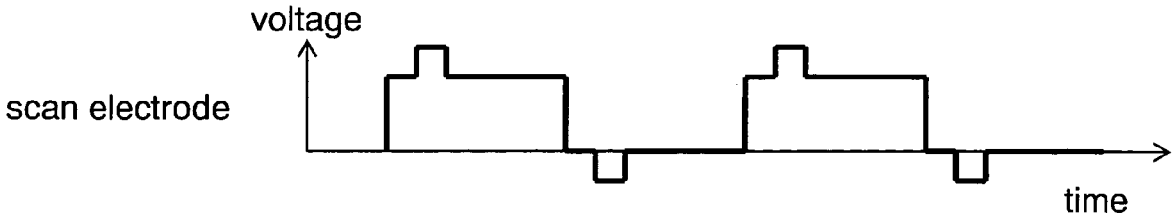
Figure 3E:
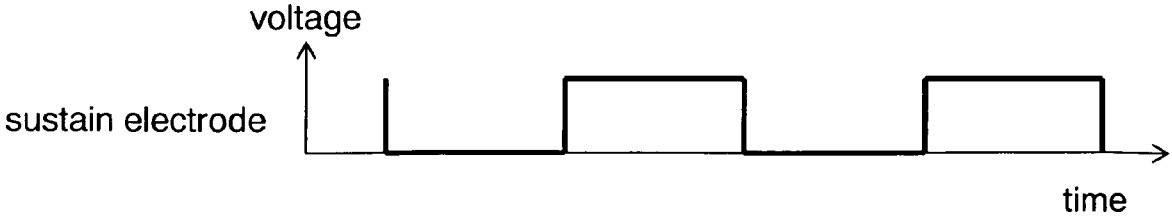

Although the waveform of voltage applied to both of scan electrodes 5 and sustain electrodes 6 has another small rise with a delayed time of td after the pulse rising time, as shown in FIGS. 3A and 3B, it is not limited thereto. A voltage having a rectangular waveform may be applied to sustain electrodes 6, and the aforementioned erase-discharge suppressing voltage may be applied to scan electrodes 5 just after the rise and the fall of the waveform, as shown in FIGS. 3D and 3E, or vice versa (not shown)—the rectangular waveform voltage may be applied to scan electrodes 5, and the erase-discharge suppressing voltage may be applied to sustain electrodes 6.

SECOND EXEMPLARY EMBODIMENT

Figure 5A:
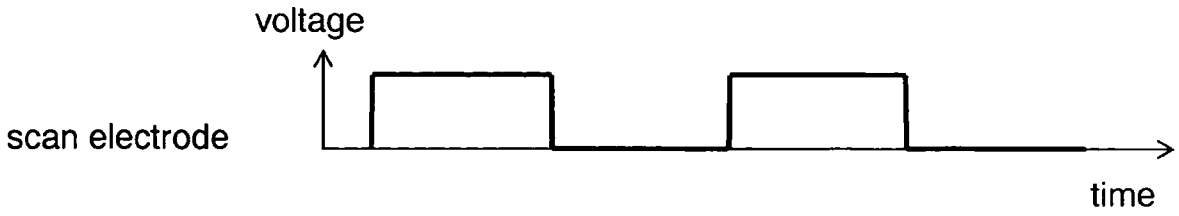
FIGS. 5A-5D show waveforms of voltage applied to an electrode in the aging method of a second embodiment.
Figure 5B:
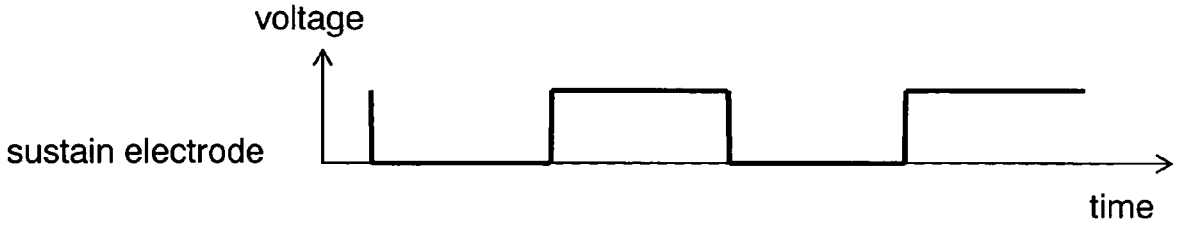
Figure 5C:
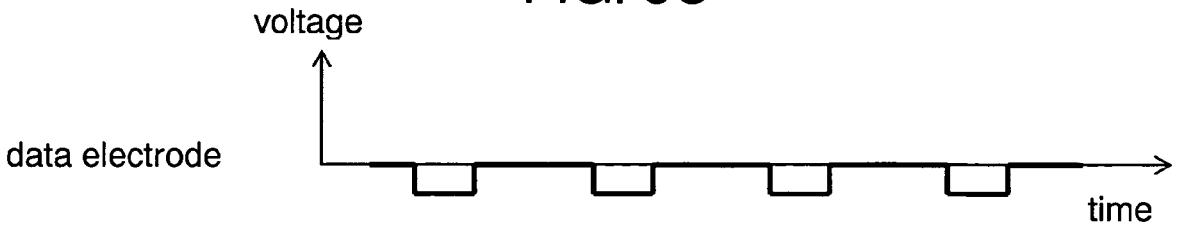
Figure 5D:
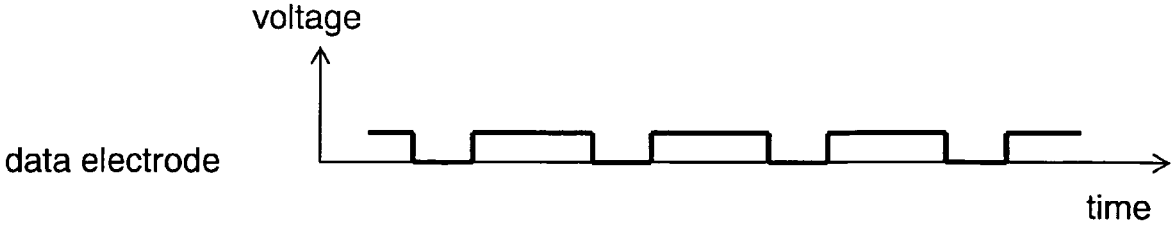

FIGS. 5A-5D show waveforms of voltage applied to an electrode in the aging method of a second embodiment. FIGS. 5A and 5B show the waveforms of voltage applied to scan electrodes 5 and sustain electrodes 6, respectively. The voltage applied to electrodes 5 and 6 is a simple rectangular pulse train having alternate voltage component. FIG. 5C shows the waveform of voltage applied to data electrodes 10. The aging method of the embodiment differs from the method of the first embodiment in that the erase discharge-suppressing voltage is applied to data electrodes 10, instead of scan electrodes 5 and sustain electrodes 6. Because data electrodes 10 do not carry a large discharge current, the method of the embodiment allows the data electrode-driving circuit to have a small power consumption and a simple structure.

Now will be described the reason why the application of voltage to data electrodes 10 can suppress the erase discharge.

Figure 6A:
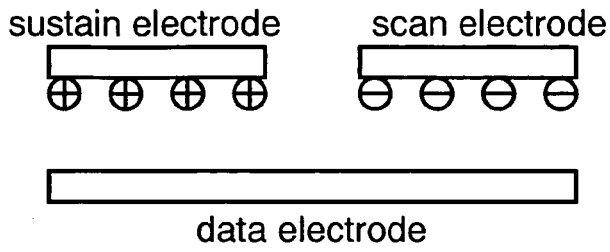
FIGS. 6A-6D illustrate the generating mechanism of an erase discharge.
Figure 6B:
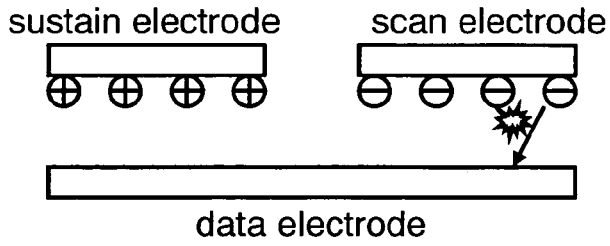
Figure 6C:
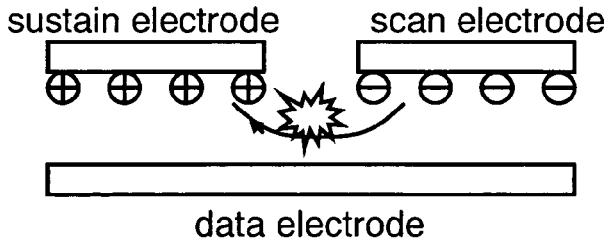

FIGS. 6A through 6D illustrate the generating mechanism of an erase discharge, showing presumable movement of the wall charge of each electrode. FIG. 6A shows the wall charge just after the completion of the major aging discharge following the application of positive voltage to scan electrode 5. Scan electrode 5 carries negative charges, while sustain electrode 6 carries positive charges. A potential drop triggered by ringing—even if the potential drop does not have enough magnitude to generate discharge between scan electrode 5 and sustain electrode 6—induces the discharge between scan electrode 5 and data electrode 10, because the discharge between those electrodes starts at a low voltage. At this time, the discharge occurred between electrodes 5 and 10 serves as a priming discharge, which substantially decreases the voltage level at the start of the discharge between scan electrode 5 and sustain electrode 6, thereby inducing the erase discharge between the scan electrode 5 and sustain electrode 6, as shown in FIG. 6C.

That is, the priming discharge initially occurred between scan electrode 5 and data electrode 10 triggers the erase discharge between scan electrode 5 and sustain electrode 6.

Figure 6D:
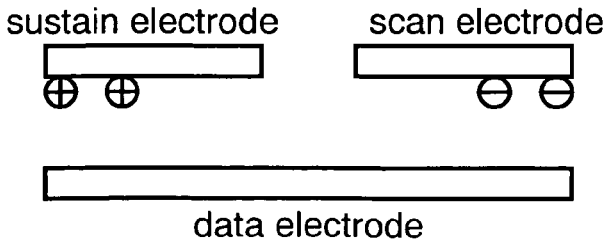

FIG. 6D shows the wall charges after completion of the erase discharge. The erase discharge decreases the amount of the wall charges, so that a large voltage is required to perform the following discharge.

As described above, suppressing the initial discharge between scan electrode 5 and data electrode 10 can also suppress the erase discharge between scan electrode 5 and sustain electrode 6. Taking this fact into consideration, negative voltage is applied to data electrode 10 at the exact moment when negative voltage is applied to scan electrode 5 by ringing, whereby the initial discharge between electrodes 5 and 10 can be suppressed, accordingly, the erase discharge can be suppressed.

In an AC-type PDP, each electrode is isolated from the discharge space, since the electrodes are covered with the dielectric layers. Therefore, a direct voltage component has no contribution to the discharge itself. The application of negative voltage to the data electrode at the moment of the occurrence of the erase discharge has the same effect as the application of positive voltage to the data electrode in a period having no erase discharge. That is, the waveforms of voltage applied to the data electrode of FIGS. 5C and 5D have the same effect.

THIRD EXEMPLARY EMBODIMENT

Figure 7A:
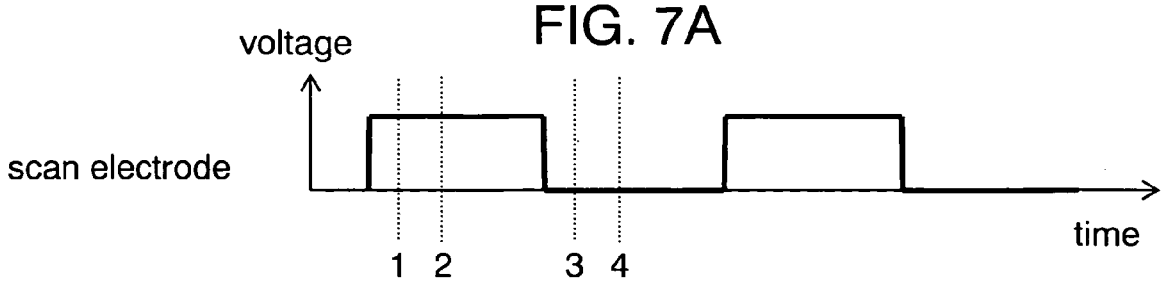
FIGS. 7A-7E show waveforms of voltage applied to an electrode in the aging method of a third embodiment.
Figure 7B:
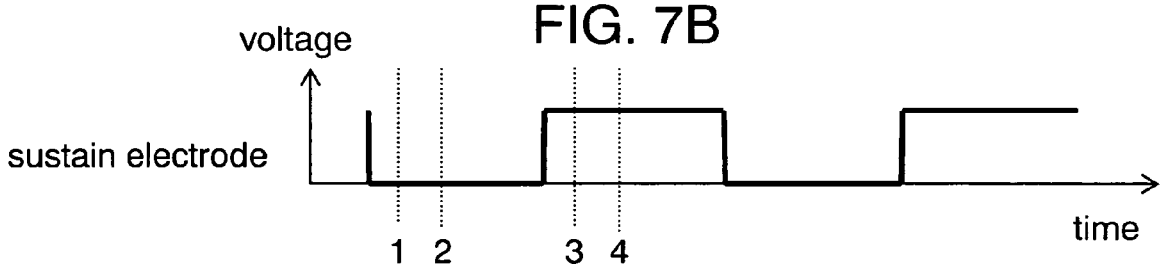
Figure 7C:
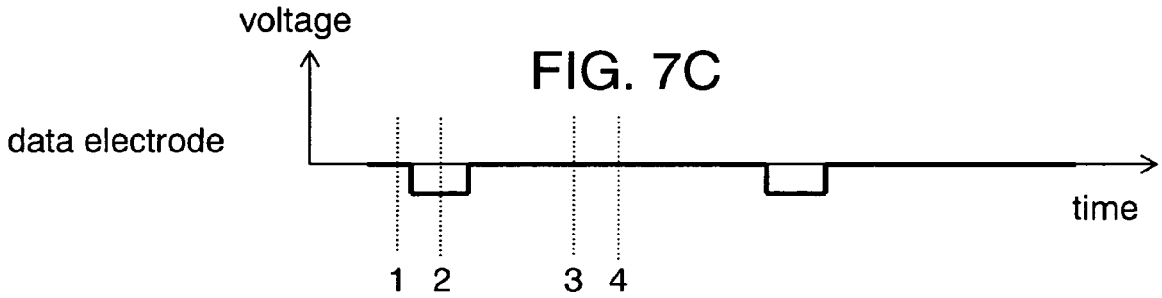

FIGS. 7A-7E show waveforms of voltage applied to an electrode in the aging method of a third embodiment. FIGS. 7A and 7B show the waveforms of voltage applied to scan electrodes 5 and sustain electrodes 6, respectively. The voltage applied to electrodes 5 and 6 is a simple rectangular pulse train having alternate voltage component. FIG. 7C shows the waveform of voltage applied to data electrodes 10. The aging method of the embodiment differs from the method of the second embodiment in that voltage is applied to data electrodes 10 to suppress the erase discharge that occurs in succession to the aging discharge in the wake of increase in voltage applied to scan electrode 5 or decrease in voltage applied to sustain electrode 6. More specifically, the aging method suppresses the erase discharge that occurs when scan electrode 5 takes voltage level higher than sustain electrode 6. Therefore, the successive discharge is intensified; and in this case, the successive discharge is the discharge that occurs in the wake of decrease in voltage applied to scan electrode 5 or increase in voltage applied to sustain electrode 6, that is, scan electrode 5 takes the lower voltage-side with respect to sustain electrode 6. In the aging discharge that occurs when scan electrode 5 takes the lower voltage-side, a region on the side of scan electrode 5 of the panel undergoes ion-sputtering caused by positive ions moving toward scan electrode 5 in the discharge space, thereby accelerating the aging. In this way, the application of the voltage waveform shown in FIG. 7C to data electrode 10 accelerates the aging of a region on the side of scan electrode 5 rather than a region on the side of sustain electrode 6.

In a sequence of initial, writing, and sustaining discharge of the 3-electrode PDP in operation, the writing discharge and the sustaining discharge are under the influence of the operating voltage. Generally in the sustaining discharge, because the rectangular pulse train generates the discharge between scan electrode 5 and sustain electrode 6, the area of each electrode close to discharge gap 20 is subjected to the discharge. As for the writing discharge, the discharge between scan electrodes 5 and data electrodes 10 is the primary discharge. The discharge occurs almost all over the surface of the regions on the side of scan electrodes 5, which face data electrodes 10. Therefore, accelerating the aging on the side of scan electrodes 5 rather than on the side of sustain electrodes 6 is effective in acquiring stability in the panel operation, compared to the aging equally performed on both sides of scan electrodes 5 and sustain electrodes 6. The inventors experimentally found that the application of voltage having the waveform shown in FIG. 7C to data electrodes 10 accelerated the aging on the side of scan electrodes 5, enhancing aging efficiency.

Figure 7D:
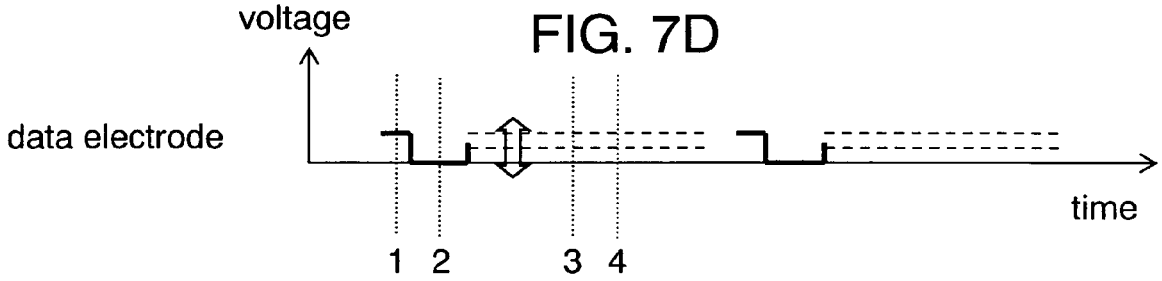
Figure 7E:
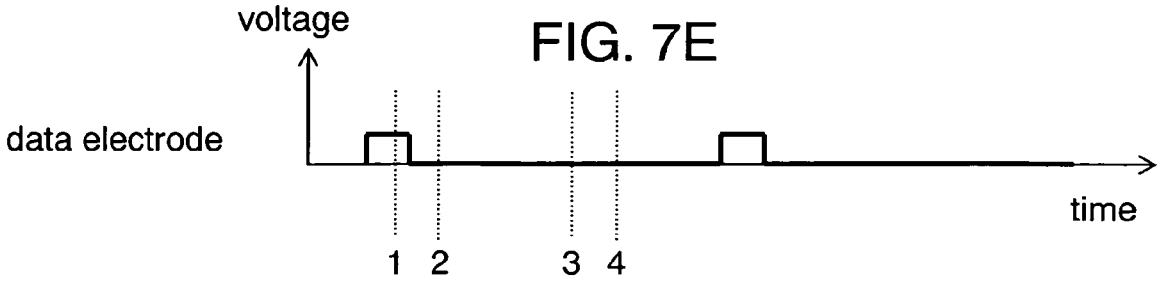

In this case, the voltage waveforms shown in FIGS. 7D and 7E are also effective, as well as the waveform shown in FIG. 7C. In both the waveforms of FIGS. 7D and 7E, the voltage level of timing 1 is higher than that of timing 2 (where, timing 1 is the moment at which the aging discharge occurs in the wake of increase in voltage applied to scan electrode 5 or decrease in voltage applied to sustain electrode 6, and timing 2 is the moment at which the erase discharge occurs after the aging discharge.)

Hereinafter will be described the reason why these waveforms are as effective as the waveform of FIG. 7C. After a strong discharge, such as the aging discharge occurred at timing 1, rearrangement of the wall charges takes place so as to ease the intensity of the electric field in the discharge cell. The rearranged wall charges, to which the potential drop by ringing is added, generate the successive erase discharge at timing 2. Therefore, the erase discharge is effectively suppressed by applying the voltage equivalent to the amount of change in voltage from the moment when the aging discharge occurs (at timing 1). In other words, if timing 1 and timing 2 have the same voltage, there is no suppressing effect on the erase discharge. The method of the embodiment focuses on the erase discharge at timing 2, not on the erase discharge at timing 4 where scan electrode 5 keeps a voltage lower than sustain electrode 6. Therefore, as long as the voltage level is the same at timing 3 and timing 4 as shown in FIG. 7D, the voltage is not limited to a specific value. That is, the voltage waveform of FIG. 7E has the same effect as those shown FIGS. 7C and 7D.

Figure 8:
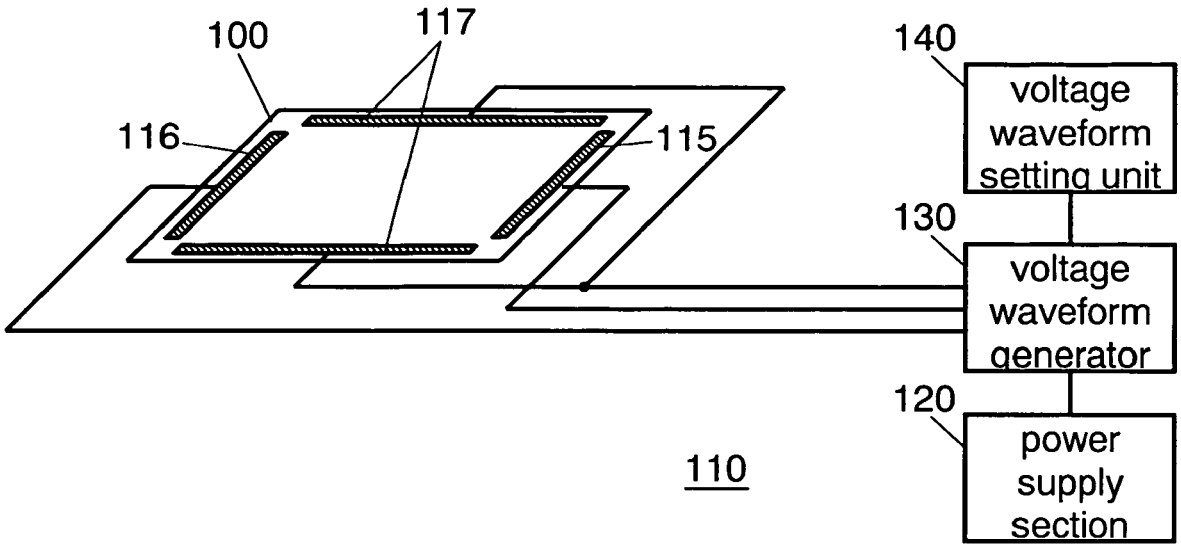
FIG. 8 is a block diagram showing the structure of an aging device for aging panels according to the aging methods described in the first through third embodiments.

FIG. 8 is a block diagram illustrating the structure of an aging device according to the aging methods of the first through the third embodiments of the present invention. Aging device 110 has power supply section 120 for feeding electric power, voltage waveform generator 130 for generating a waveform of voltage to be applied to each electrode, voltage waveform setting unit 140 for defining a voltage waveform for each electrode, and panel table (not shown) for mounting panel 100 on which aging is to be performed.

A plurality of scan electrode terminal sections $15_1$-$15_n$ disposed on panel 100, which is short-circuited by short-circuit bar 115, is connected to the scan electrode output section of voltage waveform generator 130 via cables. Similarly, sustain electrode terminal sections $16_1$-$16_n$ and data electrode terminal sections $17_1$-$17_n$, which are short-circuited by short-circuit bars 116 and 117, respectively, are connected to voltage waveform generator 130. Voltage waveform generator 130 generates and supplies a voltage waveform suitable for scan electrode 5, sustain electrode 6, and data electrode 10 of panel 100, as is described in the first through the third embodiments, thereby performing the aging process. Voltage waveform setting unit 140 determines the optimal setting values, such as the pulse-repetition frequency, the timing and value of the application of voltage, according to panel 100 to be processed.

Figure 9A:
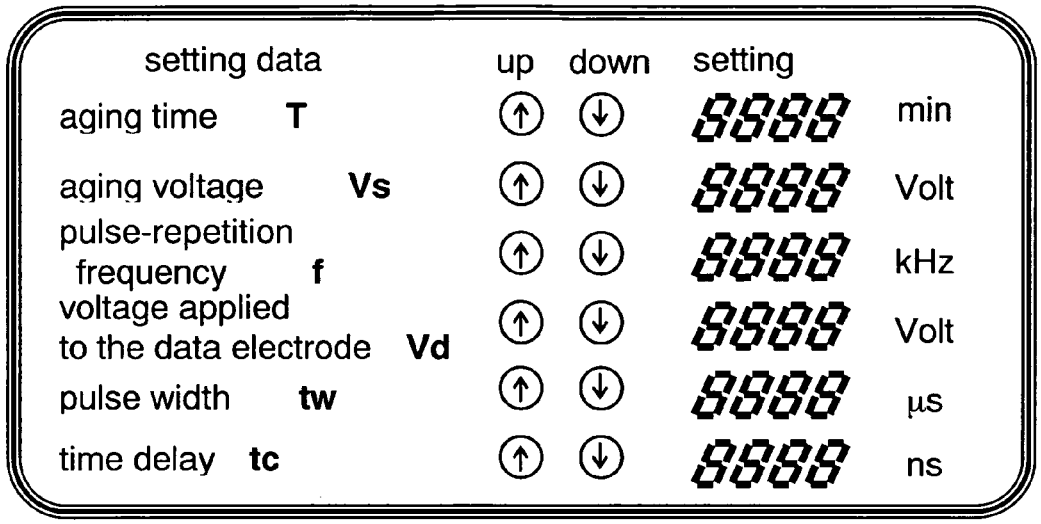
FIG. 9A shows the appearance of voltage waveform setting unit of a device for aging panels according to the aging methods described in the first through third embodiments.
Figure 9B:
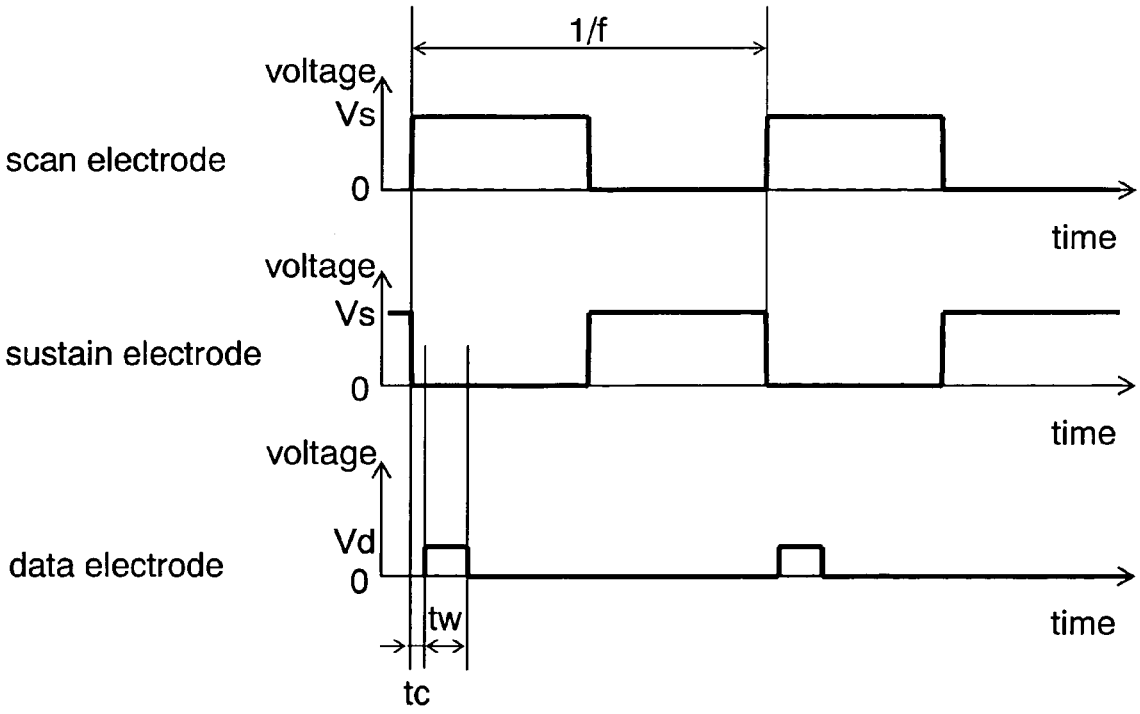
FIG. 9B illustrates the setting values to be defined in the voltage waveform setting unit by showing a waveform of voltage applied to each electrode according to the third embodiment.

FIG. 9A shows an appearance of voltage waveform setting unit 140 of the aforementioned aging device. FIG. 9B illustrates the setting values to be defined in setting unit 140 by showing a waveform of voltage applied to each electrode according to the third embodiment. In voltage waveform setting unit 140 shown in FIG. 9A, aging time (T), alternating waveform voltage value to be applied to the scan electrode and sustain electrode (Vs), pulse-repetition frequency (f), pulse waveform voltage value to be applied to the data electrode (Vd), pulse width (tw), and pulse-repetition period (tc) can be individually defined. Although no particular description is given to the pulse-repetition period, the setting of the pulse-repetition period should preferably be adjustable. It is useful not only for performing the aging process on various kinds of panel 100, but also for adapting the manufacturing environment, such as controlling inductance of the aging circuit that depends on the length of wiring of a pallet used for conveying the panels.

Figure 10:
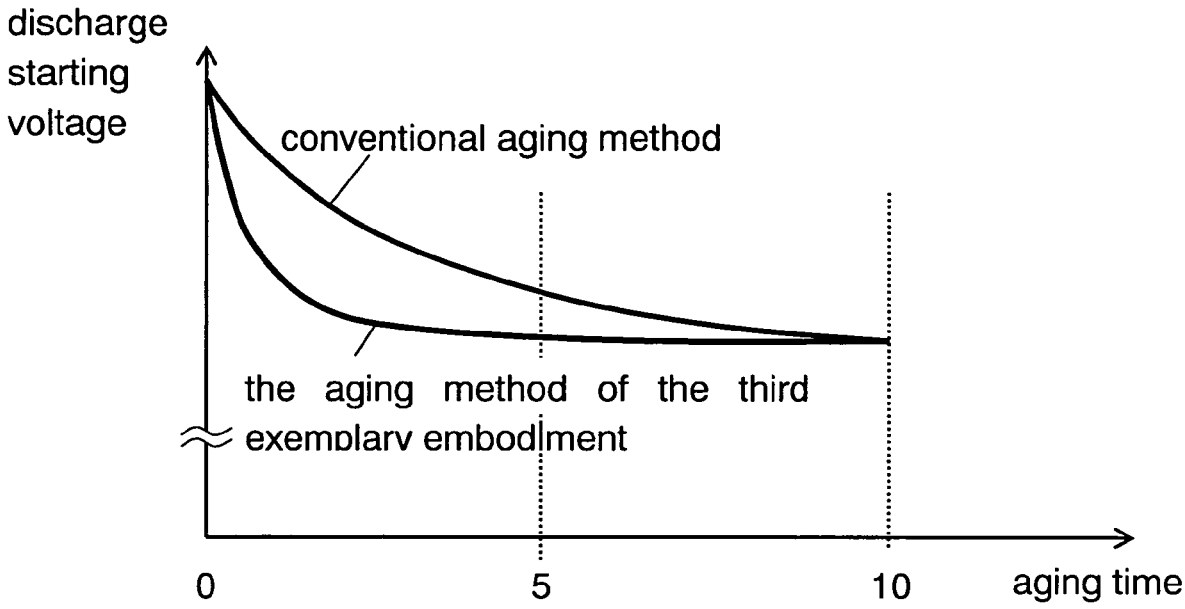
FIG. 10 shows the aging time shortened by the aging method of the third embodiment in comparison with the time required in a conventional aging method.

FIG. 10 shows the aging time shortened by the aging method of the third embodiment in comparison with the time required in a conventional aging method. In the graph of FIG. 10, the horizontal axis represents the aging time, and the vertical axis represents the voltage at the start of discharge between the scan electrodes and the sustain electrodes. The aging process is completed when the discharge starting voltage decreases to a predetermined value. In a conventional aging method, it took about 10 hours for the aging process due to the slow decrease in the voltage. In contrast, according to the aging method of the third embodiment, the discharge starting voltage decreases with a steep curve to have stability, which is achieved in about one-third the time of the conventional aging.

As described above, the aging method of the present invention realizes an electrically efficient aging process with greatly reduced aging time.

INDUSTRIAL APPLICABILITY

The method of aging a plasma display panel of the present invention can provide electrically efficient aging with substantial reductions in time required for to the aging process. It is therefore useful for aging AC plasma display panels in the manufacturing process.

The invention claimed is:

1. A method of aging a plasma display panel containing a scan electrode, a sustain electrode, and a data electrode, the method comprising:

when applying a voltage having an alternating voltage component at least between the scan electrode and the sustain electrode to perform an aging discharge, applying an erase discharge-suppressing voltage for suppressing an erase discharge that occurs after the aging discharge to at least one of the scan electrode and the sustain electrode, at a predetermined moment in each of a portion of a period of the alternating voltage component of the voltage when the scan electrode has a voltage level that is higher than that of the sustain electrode and a portion of the period of the alternating voltage component of the voltage when the sustain electrode has a voltage level that is higher than that of the scan electrode.

2. The method of aging the plasma display panel of claim 1, wherein the erase discharge-suppressing voltage is applied in each of the portions of the period of the alternating voltage component of the voltage to only one of the sustain electrode and the scan electrode which has the higher voltage level.

3. The method of aging the plasma display panel of claim 1, wherein the erase discharge-suppressing voltage is applied to one of the scan electrode and the sustain electrode.

4. The method of aging the plasma display panel of claim 1, wherein the predetermined moment is a moment when the erase discharge occurs.

5. A method of aging a plasma display panel containing a scan electrode, a sustain electrode, and a data electrode, the method comprising:

when applying a voltage having an alternating voltage component at least between the scan electrode and the sustain electrode to perform an aging discharge, applying an erase discharge-suppressing voltage for suppressing an erase discharge that occurs after the aging discharge to the data electrode, at a predetermined moment in a portion of a period of the alternating voltage component of the voltage when the scan electrode has a voltage level that is higher than that of the sustain electrode.

6. The method of aging the plasma display panel of claim 5, wherein the applying of the erase discharge-suppressing voltage further includes applying the erase discharge-suppressing voltage to the data electrode at a predetermined moment in a portion of the period of the alternating voltage component of the voltage when the sustain electrode has a voltage level that is higher than that of the scan electrode.

7. The method of aging the plasma display panel of claim 6, wherein a voltage level of the data electrode at a time when the aging discharge occurs is higher than a voltage level of the data electrode at a time when the erase discharge occurs, in the portion of the period of the alternating voltage component of the voltage when the sustain electrode has a voltage level that is higher than that of the scan electrode.

8. The method of aging the plasma display panel of claim 5, wherein a voltage level of the data electrode at a time when the aging discharge occurs is higher than a voltage level of the data electrode at a time when the erase discharge occurs, in the portion of the period of the alternating voltage component of the voltage when the scan electrode has a voltage level that is higher than that of the sustain electrode.

* * * * *